United States Patent [19]

Freihage

[11] 4,273,075

[45] Jun. 16, 1981

[54] HEAT GENERATING DEVICE

[76] Inventor: Dean A. Freihage, Afton, Iowa 50830

[21] Appl. No.: 73,221

[22] Filed: Sep. 7, 1979

[51] Int. Cl.[3] ..... F22B 3/06; F24C 9/00

[52] U.S. Cl. ..... 122/26; 126/247; 165/86; 416/96 A

[58] Field of Search ..... 126/247, 117; 122/26; 165/109, 85, 86, 87, 89, 90, 92; 415/177, 178; 416/95, 96 R, 96 A

[56] References Cited

U.S. PATENT DOCUMENTS

| | | | |
|---|---|---|---|
| 361,164 | 4/1887 | Kilbourn | 126/247 |
| 561,445 | 6/1896 | Schultze | 126/247 |
| 1,366,455 | 1/1921 | Henson | 126/247 |
| 1,598,289 | 8/1926 | Lee | 122/26 |
| 2,344,075 | 3/1944 | Beldimano | 122/26 |
| 2,683,448 | 7/1954 | Smith | 126/247 |
| 2,991,764 | 7/1961 | French | 126/247 |
| 3,187,802 | 6/1965 | Hickey | 165/109 |
| 3,348,608 | 10/1967 | Ling et al. | 165/109 |
| 3,467,179 | 9/1969 | Tevis et al. | 126/247 |
| 4,143,639 | 3/1979 | Frenette | 122/26 |

FOREIGN PATENT DOCUMENTS

| | | | |
|---|---|---|---|
| 88270 | 10/1919 | Switzerland | 122/26 |
| 846752 | 8/1960 | United Kingdom | 126/247 |
| 615327 | 7/1978 | U.S.S.R. | 126/247 |

*Primary Examiner*—Daniel J. O'Connor
*Attorney, Agent, or Firm*—Morton S. Adler

[57] ABSTRACT

A heat generating device includes a sealed metal drum with spaced peripheral fins and houses a cage-like agitator mounted on a rotatable shaft axially disposed therein and extending through one end for connection to a source of power. The agitator includes a plurality of elongated flat bar-like vanes arranged in close concentric relationship to the drum and supported by spaced apertured hubs on the shaft. The periphery of each hub has serrated type notches so that the vanes are tangential to the hubs and in off-set alignment with each other. Relative to the direction of rotation of the agitator, the leading edge of each vane is spaced inwardly from the trailing edge of the adjacent vane a predetermined distance to provide a restricted passageway. A supply of oil within the drum is forcibly driven by rotation of the agitator through the restricted passageways to the inner wall of the drum and upwardly thereon to return to the interior of the agitator through the hubs for repeated circulation through the passageways. The oil is heated by the shearing force of movement between the vanes to heat the drum and fins and means are provided to distribute heat radiating from the drum and fins to any desired point of use. An expansion and accumulator chamber communicating with the interior of the drum is provided for heated air.

5 Claims, 8 Drawing Figures

HEAT GENERATING DEVICE

BACKGROUND OF THE INVENTION

This invention relates to an improved heat generating device of the type utilizing a liquid such as oil as the heat transfer medium and more particularly to improved apparatus for heating the oil by friction, for absorbing the created heat and distributing it to a point of use.

Heat generating devices using air or oil as the heat transfer medium are well known and examples may be found in such patents as U.S. Pat. Nos. 2,625,929, 3,481,322, 3,791,167 and 3,813,036. The present invention discloses improvements over such devices in efficiency and economy and with considerably less complicated and sophisticated construction.

In general, the present invention comprises a sealed drum of heat conducting material containing a relatively small amount of oil and an internal cage-like agitator rotatable in closely spaced relationship to the inner wall of the drum. Rotation of the agitator acts to drive the oil through restricted passageways therein against the drum whereby the oil is heated by friction and the heat is absorbed and radiated by the drum from which it is preferably moved by a blower means to any desired point of use.

Accordingly, the important objects of this invention are to provide a heat generating device of the type characterized which is simple in construction, economical to manufacture and operate, highly efficient and safe in use, environmentally clean and generally improved over similar type devices previously known.

More particularly, one of the objects of this invention in a heat generating device of the above class is to provide a new and improved agitator means for generating heat from the oil heat transfer medium.

A further object is to provide a heat generator as characterized in which the oil does not foam.

Still another object herein is to provide a heat generator of the above class particularly adaptable for residential and industrial furnaces as well as other uses including water heaters and the like.

The foregoing objects and such further objects as may appear herein, or be hereinafter pointed out, together with the advantages of this invention will be more fully discussed and developed in the more detailed description of the accompanying drawings.

DESCRIPTION OF THE PREFERRED EMBODIMENTS

Figure 3:
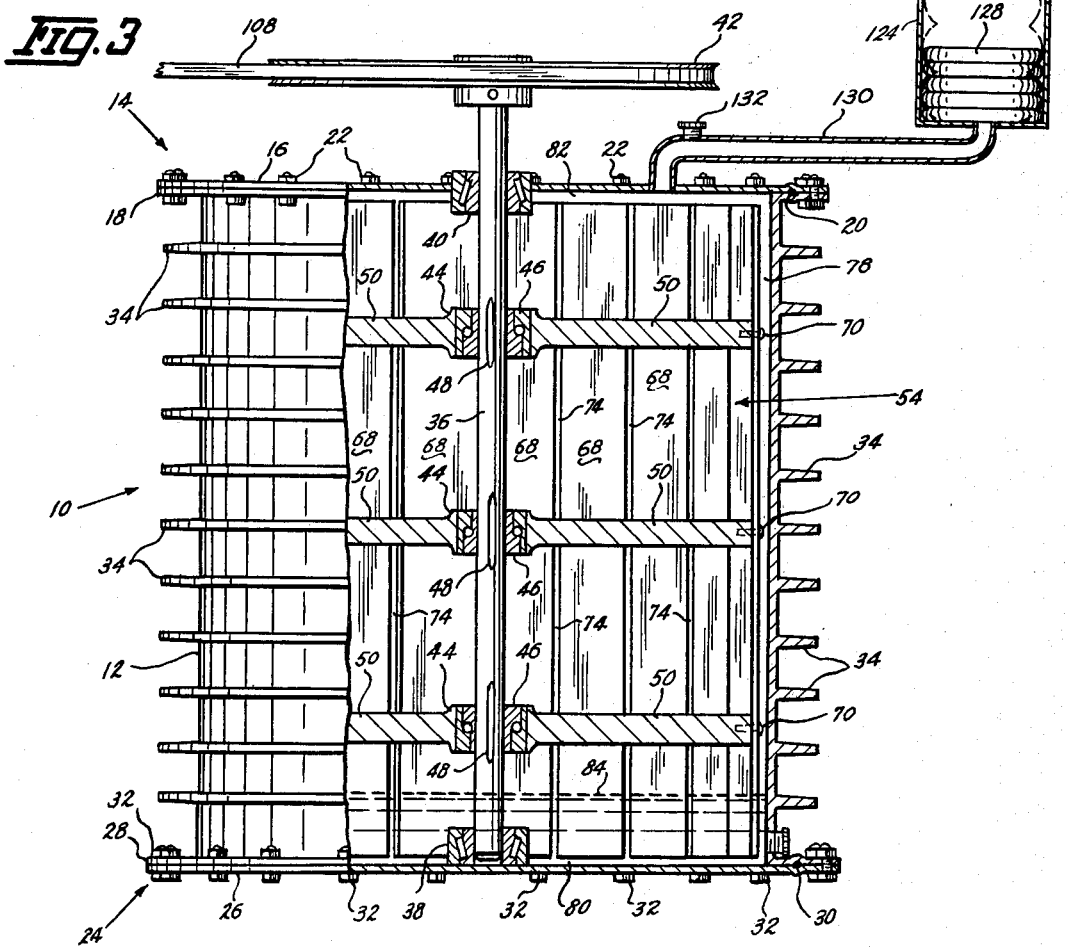
FIG. 3 is a cross sectional view taken on the line 3—3 of FIG. 2.
Figure 6:
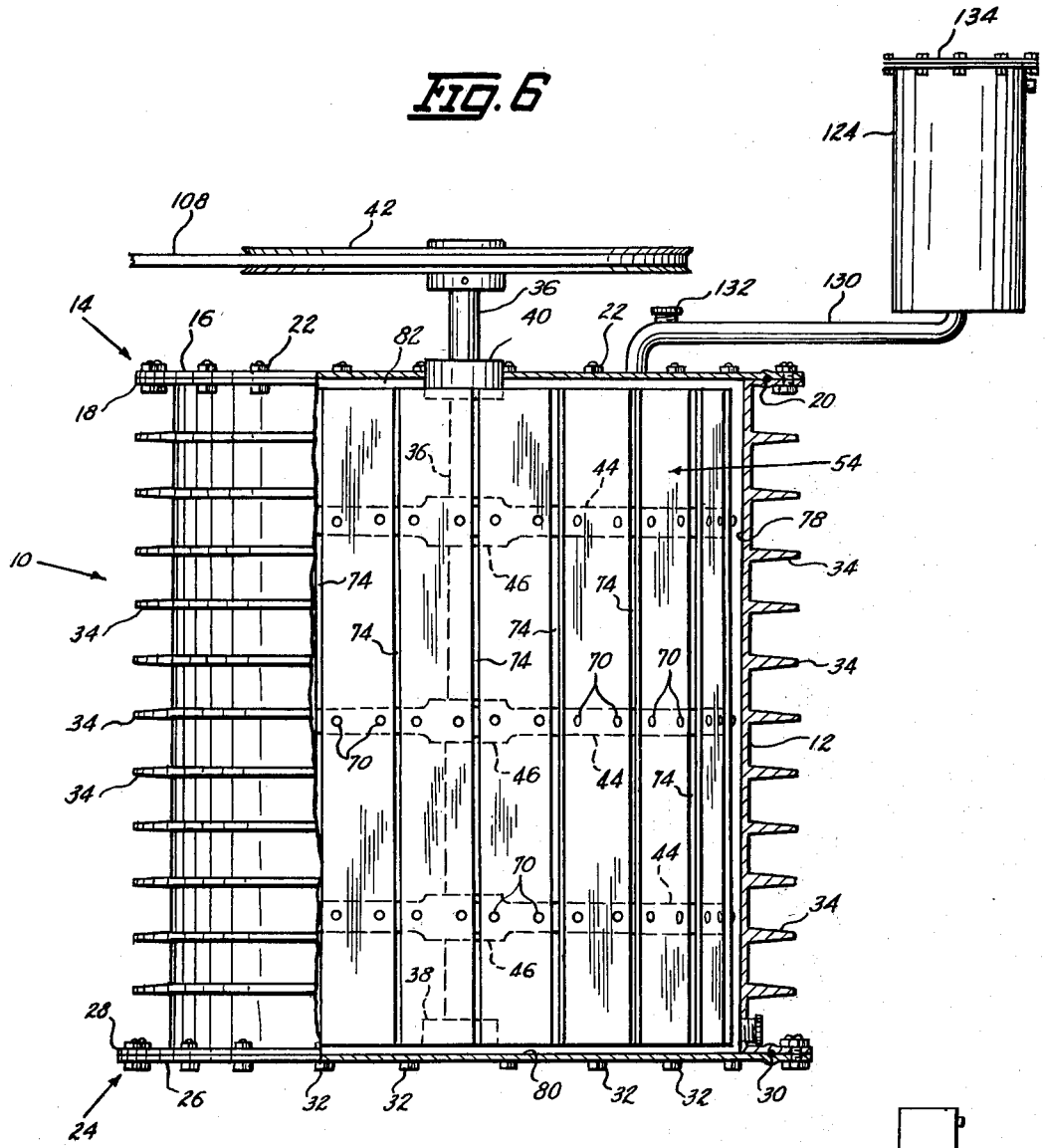
FIG. 6 is an enlarged side elevational view of the drum used with this invention broken away to more clearly illustrate the agitator therein.

Referring to the drawings, this new heat generating device is designated generally by the numeral 10 as best seen in FIGS. 3 and 6 and includes a drum 12 of good heat absorbing and conducting material for which I have preferably used an aluminum alloy. The top 14 of the drum 12 is closed and sealed by the top cover plate 16 secured to the top peripheral flange 18 and O-ring 20 by the bolt and nut fasteners 22. The bottom 24 of drum 12 is similarly closed and sealed by the bottom plate 26 secured to the bottom peripheral flange 28 and O-ring 30 by the bolt and nut fasteners 32. Intermediate the top and bottom flanges 18, 28, the periphery of drum 12 is provided with a plurality of spaced circumscribing fins 34.

A rotatable shaft 36 is axially disposed within drum 12 being mounted in suitable bearings 38 at the bottom and 40 at the top where it projects beyond the top plate 16 to carry a pulley wheel 42. A plurality of like hubs 44 having suitable axial bearings 46 are journalled on shaft 36 in longitudinal spaced relationship thereon and are keyed 48 thereto for rotation therewith. Hubs 44 are formed with the radial spokes 50 to provide the openings or passageways 52 there-through for purposes that will later appear and thus, any other hub construction providing through passageways may be utilized.

Figure 2:
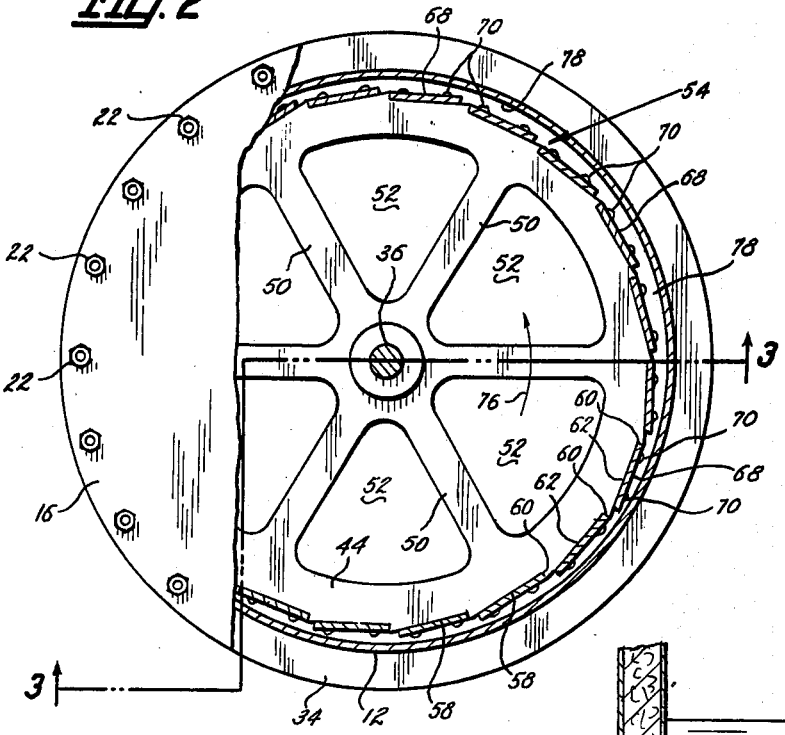
FIG. 2 is a top view of the drum shown at the right in FIG. 1 with portions cut away to more clearly show the interior thereof.
Figure 4:
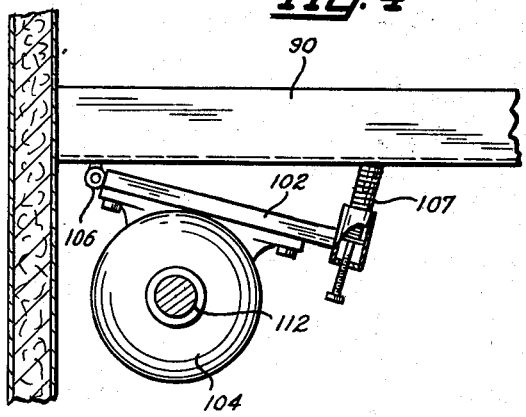
FIG. 4 is an elevational view, partly in section, of the blower motor mount taken from the line 4—4 of FIG. 1.
Figure 7:
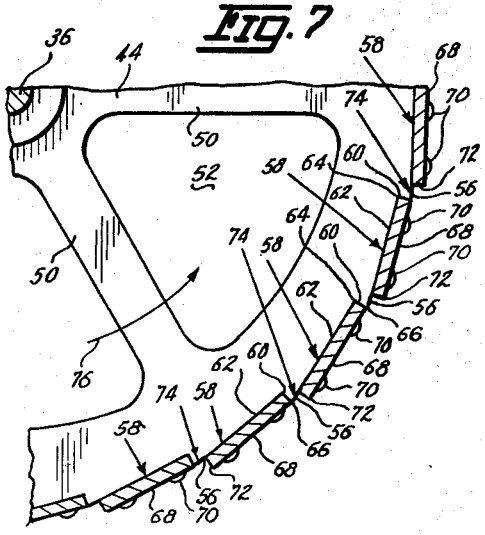
FIG. 7 is an enlarged fragmentary view of one of the hubs within the drum to show the arrangement of the agitator vanes thereon.

Hubs 44 support a cage-like agitator designated generally by the numeral 54 as best seen in FIGS. 2, 3 and 6 and constructed as follows. The perimeter 56 of each hub 44 is serrated or sawtooth like in outline by the endless succession of L-shaped notches 58 having the respective short side 60 and long side 62 as best seen in FIG. 7. Each short side 60 extends first radially inwardly to point 64 with the long side 62 extending from point 64 laterally and angularly to point 66 spaced from side 60 on the perimeter 56 that intersects with the adjacent short side 60 and by this arrangement, the perimeter surface formed by the long notch side 62 is tangentially disposed relative to the axis of hub 44. It will be understood that the perimeter of each hub 44 is similarly constructed and with hubs 44 arranged so that the respective notches 58 are in alignment, an encircling arrangement of elongated flat bar shaped vanes 68 are seated in the respective aligned notches 58 and secured to each hub 44 by any suitable fasteners such as rivets 70 or the like. The thickness of vanes 68 is complementary to the depth of the short side 60 of notch 58 and each vane 68 is seated against notch sides 60, 62 as best seen in FIG. 7. The width of the vanes 68 is slightly less than the length of the long notch side 62 so that end 72 of each vane 68 terminates in spaced relationship to the next adjacent short notch side 60 to provide a restricted passageway 74 therebetween. Hubs 44 are designed to rotate counterclockwise as indicated by arrow 76 (FIGS. 2, 7) so that relative to the direction of rotation for purposes of description, the edge of a vane 68 abutting the short notch side 60 is the leading edge and vane edge 72 is the trailing edge and thus arranged, the leading edge of each vane is disposed radially inwardly from and laterally spaced from the trailing edge of the adjacent vane. The diameter of agitator 54 is designed so that vanes 68 rotate in close proximity to drum 12 to define generally the circular chamber 78 which is preferably on the order of one eighth of an inch in width as best seen in FIGS. 3, 6. Likewise, the length of vanes 68 are such that they are similarly spaced from the bottom plate 26 and top plate 16 to form the respective chambers 80, 82. Drum 12 is provided with a relatively small amount of oil 84 as seen in FIG. 3.

Figure 1:
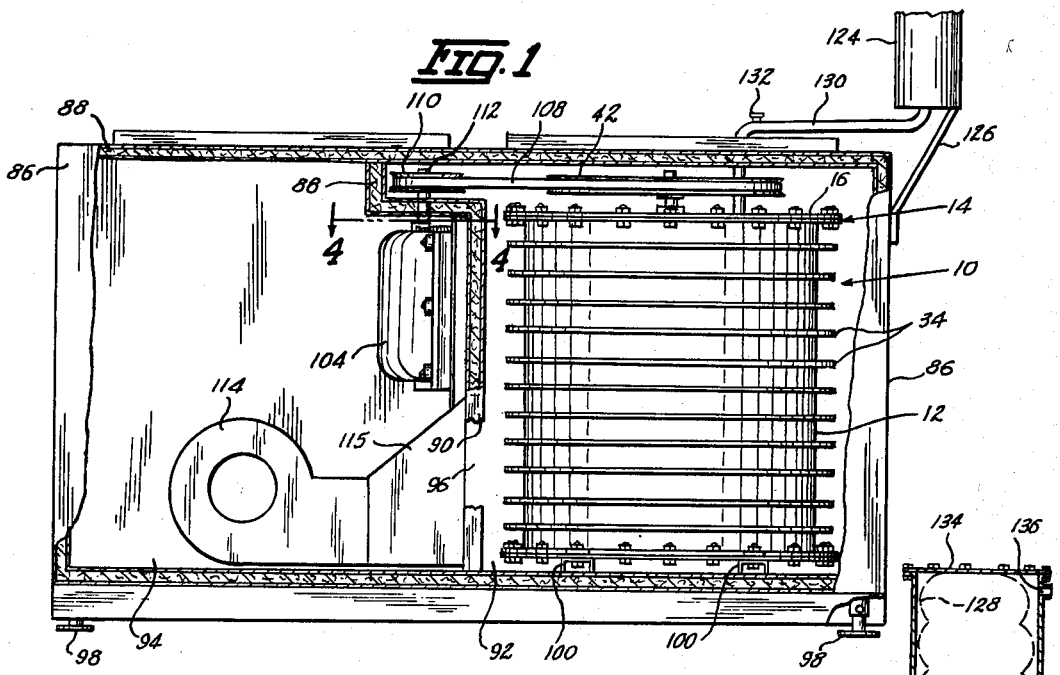
FIG. 1 is a side elevational view of this invention shown mounted in a furnace cabinet with portions of the cabinet broken away to more clearly show the invention.
Figure 5:
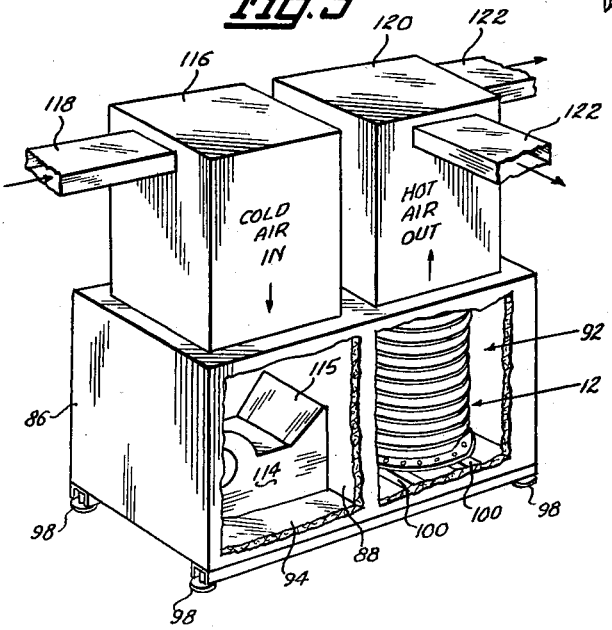
FIG. 5 is a reduced perspective view, partly cut away, showing this heat generator in a furnace cabinet and including hot and cold air ducts.
Figure 8:
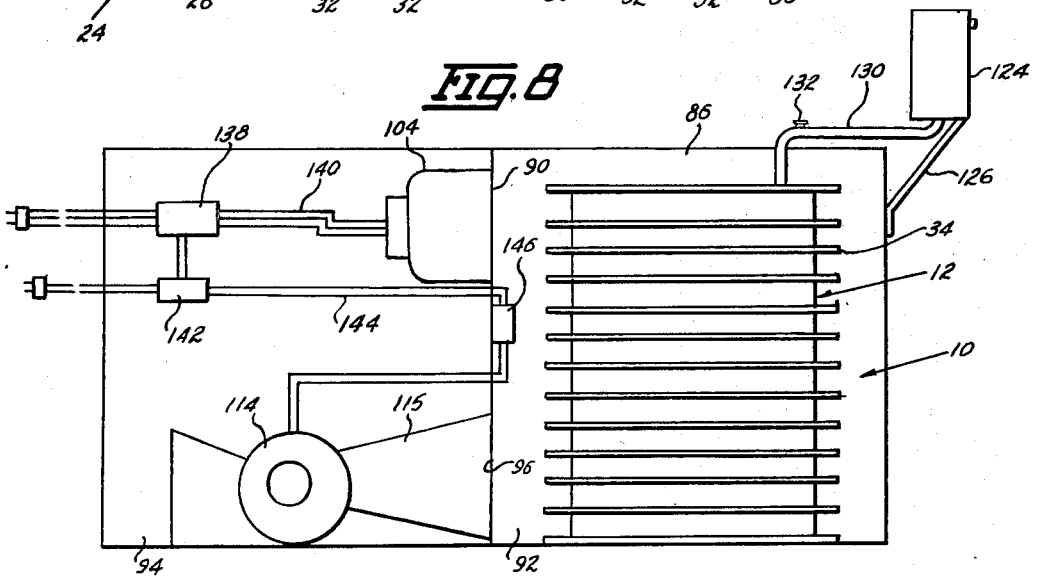
FIG. 8 is a schematic view of the furnace cabinet showing in general the wiring arrangement used with this invention.

In FIGS. 1, 5 and 8, heat generator 10 is shown in a preferred use in a furnace installation described as follows. A generally rectangular cabinet 86 having insulated walls 88 is divided by partition 90 into the heating chamber 92 and the blower chamber 94 that are in air flow communication with each other through opening 96 in partition 90. Cabinet 86 is also provided with adjustable legs 98 for purposes of levelling in a well known manner. Drum 12 is secured within chamber 92 and elevated from the chamber floor by suitable mounting brackets 100 so that air can be circulated relative to all external areas of the drum. In chamber 94, a motor mount 102 carrying an electric motor 104 is hingedly 106 secured at one end to partition 90 and spring loaded 107 at the other end to maintain tension on belt 108 from pulley 42 on shaft 36 to pulley 110 on shaft 112 of motor 104 in a well known matter. A standard furnace blower 114 is mounted in chamber 94 in air flow communication with chamber 92 through opening 96 by means of chute 115.

Mounted on top of cabinet 86 over chamber 94 and in communication therewith is a cold air return chamber 116 serving one or more cold air return ducts 118 and a hot air delivery chamber 120 over chamber 92 and in communication therewith. Ducts 122 from chamber 120 can extend to any desired point or area as is well known. An expansion tank 124 for hot air accumulation is supported outside chamber 92 by brace 126 to cabinet 86 and within tank 124, there is an inflatable bladder 128 connected to the interior of chamber 92 by the conduit 130. Conduit 130 by means of plug 132 therein also serves as the means for supplying oil 84 to the interior of drum 12. The top of tank 124 is provided with the removable cap 134 and the vent opening 136.

Within chamber 94 is a terminal box 138 providing a three line 220v electrical service 140 to motor 104 from a source of power (not shown) and a connecting terminal 142 stepped down to 110v providing electrical power through line 144 to a thermostat 146 in chamber 92 and blower 114, all in a well known manner.

Operation

Agitator 54 is rotated counterclockwise by motor 104 through belt 108. The rotation speed may be in the range of four hundred to seven hundred rpms and preferably at approximately five hundred eighty five rpms. During such rotation, oil 84 is picked up from the bottom of drum 12 and forcibly driven by vanes 68 through passageways 74 into chamber 78 against the inner drum wall. In this action, the arrangement of vanes 68 described produce a shearing and friction generating force on lil 84 with the oil traveling upwardly against the drum 12 and then back down to the interior of agitator 54 through hub openings 52 for repeated movement through passageways 74. Heat from the oil 84 is absorbed by the drum 12 and fins 34 and blower 114 effectively circulates air all around drum 12 in chamber 92 to supply heated air to ducts 122 and it will be appreciated that the use of fins 34 substantially increases the drum surface from which air can be heated. Thermostat 146 which preferably set at one hundred eighty degrees controls the operation of blower 114 in a well known manner. Expansion of heated air in chamber 92 is accommodated by tank 124 and bladder 128 prevents any oil contaminants from escaping to the atmosphere. Bladder 128 will expand within tank 124 as it fills with air and will retract when generator 10 cools down from non-operation.

By way of illustration and example only, it is noted that heat generator 10 as shown represents a drum approximately twenty inches in diameter and twenty four inches long requiring one gallon of oil that will be approximately one inch deep within the drum when the agitator is at rest. This will supply heat for two thousand square feet more or less and it will be understood that different sized drums can be provided for varying areas to be heated.

It is recommended that a five weight oil be used with five percent powdered graphite and a suitable defoaming agent. Further, in the arrangement of vanes 68, it has been found satisfactory to provide them with a one eighth inch pitch, one eighth inch clearance to drum 12 and one eighth inch spacing for passageways 74. These dimensions may, of course, be varied without departing from the principles of this invention.

Since drum 12 is sealed as described, no fire hazard is present with the agitator speed and no polution escapes to the outside because of tank 124. With the furnace installation (FIG. 5), it will be appreciated that all wiring, belts and related parts are housed within cabinet 86 for safety purposes. However, as will be apparent, heat generator 10 may be separately used as a heat radiating unit and does not necessarily require placement in a furnace installation. Accordingly, in view of the foregoing, it is thought a full understanding of the construction and operation of this invention will be had and the advantages of the same will be appreciated.

I claim:

1. A heat generator, comprising:

a sealed drum of heat conducting material, a shaft axially mounted in said drum and projecting from one end thereof, means for rotating said shaft, a plurality of hubs keyed to said shaft in longitudinal spaced relationship thereon, the perimeter of each hub being provided with an endless succession of continuous notches with each notch having a short side extending radially inwardly to a long side extending laterally therefrom and tangentially back to the perimeter to the point of the next short notch side, a respective elongated flat bar vane seated in respective aligned notches on said hubs and secured thereto, relative to the direction of rotation of said hubs, the vane side seated against said short notch side defined as the leading vane edge and the opposite vane edge being the trailing edge, the leading edge of each vane being spaced inwardly from the trailing edge of an adjacent vane to define a restricted passageway therebetween, a supply of oil in said drum, and the rotation of said hubs and vanes acting to forcibly drive said oil through said passageways in heat generating friction contact to effectively heat said drum from which the heat is radiated.

2. A heat generator as defined in claim 1 including means to distribute heat radiating from said drum to selected points of use.

3. A heat generator as defined in claims 1 or 2 including spaced peripheral fins on said drum.

4. A heat generator as defined in claims 1 or 2 including an inflatable and deflatable heated air expansion accumulator means in communication with the interior of said drum.

5. A heat generator as defined in claims 1 or 2 including:

said hubs being apertured, said vanes being in closely spaced concentric relationship to said drum, and said oil being driven from within the encirclement of said vanes through said passageways against said drum and upwardly thereon to return through said hubs for repeated circulation.

* * * * *